United States Patent [19]

Lea et al.

[11] Patent Number: 4,624,877

[45] Date of Patent: Nov. 25, 1986

[54] INFLATABLE MATTRESS AND METHOD OF MAKING THE SAME

[75] Inventors: James M. Lea; Peter D. Haggerty, both of Seattle, Wash.

[73] Assignee: Cascade Designs, Inc., Seattle, Wash.

[21] Appl. No.: 549,238

[22] Filed: Nov. 4, 1983

[51] Int. Cl.[4] ..... B32B 3/00

[52] U.S. Cl. ..... 428/71; 5/449; 156/87; 156/182; 156/213; 156/303.1; 156/306.6; 156/315; 156/324; 156/324.4; 428/76; 428/212; 428/252; 428/308.4; 428/316.6; 428/317.7; 428/319.7

[58] Field of Search ..... 156/87, 303.1, 315, 156/324.4, 324, 182, 213, 306.6; 428/71, 212, 76, 252, 308.4, 316.6, 317.7, 319.7; 5/449

[56] References Cited

U.S. PATENT DOCUMENTS

| | | | |
|---|---|---|---|
| 4,129,676 | 12/1978 | Guglielmo | 428/319.7 |
| 4,149,919 | 4/1979 | Lea et al. | 156/213 |
| 4,350,734 | 9/1982 | Hammond | 428/308.4 |
| 4,357,725 | 11/1982 | Ahlm | 428/71 |

*Primary Examiner*—John J. Gallagher
*Attorney, Agent, or Firm*—Hughes & Cassidy

[57] ABSTRACT

A method of making a self-inflating air mattress comprising an open cell foam core enclosed within, and bonded to, upper and lower sheets. Each sheet is made by heat laminating to an outer substantially nonstretching fiber layer an intermediate solid polymer film layer to which is then heat laminated an inner solid polymer film layer having a melting temperature at which the intermediate film layer is structurally stable. The sheets are pressed against the foam core by heated platens, and afterwards cooled. These particular sheets form a reliable bond and alleviate a problem of creating air leaks through the intermediate film layer.

26 Claims, 13 Drawing Figures

FIG. 1
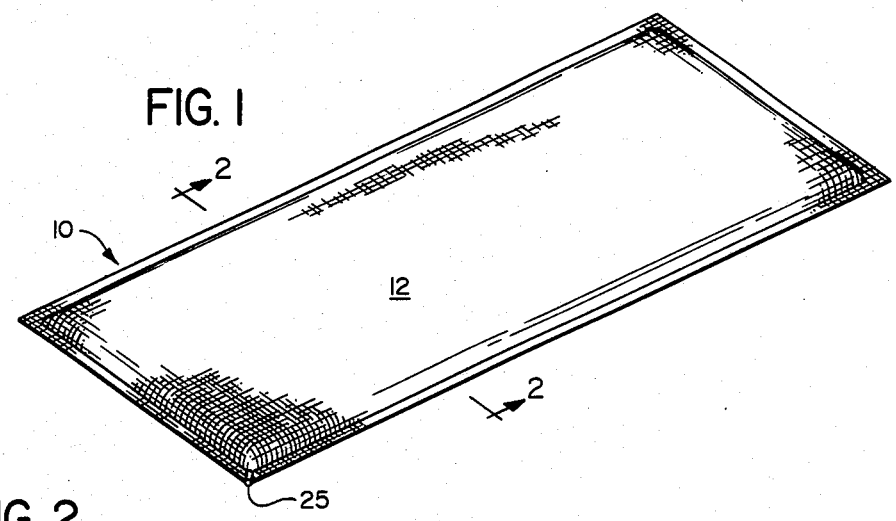
FIG. 2
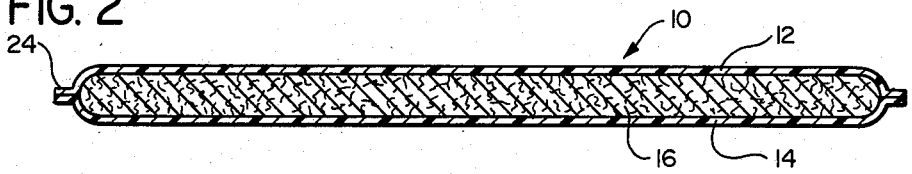
FIG. 3
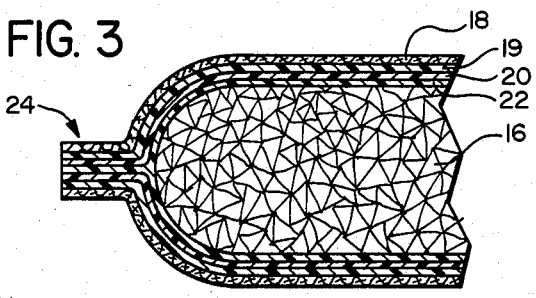
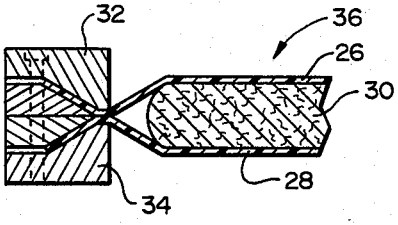
FIG. 4
FIG. 5
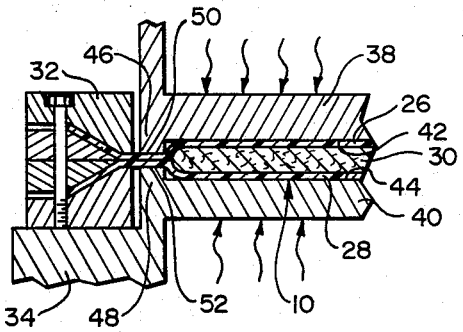

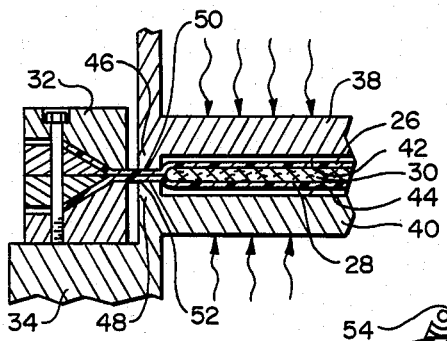
FIG. 6
FIG. 7
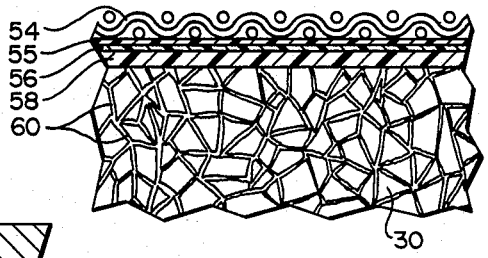
FIG. 8
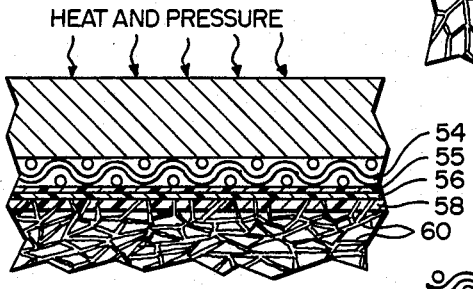
FIG. 9
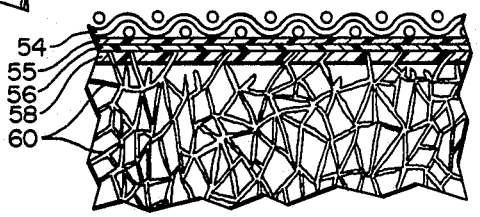
FIG. 10
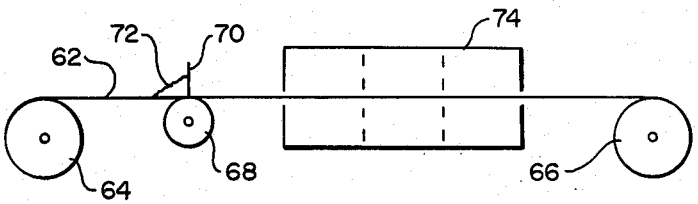
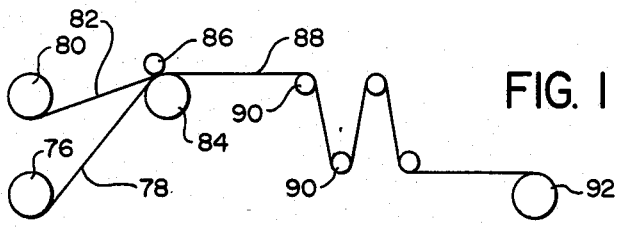
FIG. 11

SHEET THICKNESS WITH SCRAPING AS A FUNCTION OF TEMPERATURE

INFLATABLE MATTRESS AND METHOD OF MAKING THE SAME

FIELD OF THE INVENTION

The present invention relates to an inflatable member, such as a self-inflating air mattress, and a method of making the same, but more particularly to an improvement for the method of making the sheet material for the inflatable member and the member utilizing such preferred sheet material.

BACKGROUND ART

In U.S. Pat. No. 4,025,974, issued May 31, 1977, Lea et al, there is described a self-inflating air mattress and method of making the same. In general, the air mattress comprises an airtight flexible jacket enclosing a core of a resilient, open cell, lightweight foam material. The upper and lower portions of the foam material are bonded to the envelope. The process of making this mattress comprises first making a prebonded assembly made up of two sheets of an air impermeable plastic coated fabric, with the foam core positioned between the two sheets. Heated platens are applied to this lay up, followed by applying a vacuum to the interior. The assembly is then cooled, and then moderate pressure is applied to the inside of the bonded assembly.

The mattress made according to the process described above functions quite effectively as a self-inflating air mattress, particularly adapted for use by campers or anywhere that weight and storage bulk are at a premium. The foam core is compressible, so the mattress can be rolled up into a relatively compact package. By closing the inflating valve with the mattress so rolled into a package, the mattress will remain in that rolled, compact configuration. By releasing the inflating valve, the expanding force exerted by the foam will cause the mattress to unroll to its extended use position, with the inflating air being drawn into the mattress. If desired, the mattress can be inflated by mouth and then the inflating valve is closed.

The mattress in its inflated condition provides very effective support for a person lying thereon. With the foam core being reliably bonded to the outer sheets, when a person lies on one part of the mattress so as to moderately compress the same, the other portions of the mattress tend to expand outwardly. However, the foam core, being bonded to the sheets or skin of the mattress, acts in tension to limit the movement of the two sheets away from one another, and at the same time maintains a moderate increase of air pressure within the mattress giving support to the person on the mattress. This increase in pressure resists further downward compression of the mattress under the person's weight, so that the mattress thus provides effective support. However, for such a mattress to function effectively, it must of course be air impervious. Further, the foam core must be reliably bonded to the upper and lower sheets which form the envelope.

The sheets which have been used in this process are generally made in layers. The first layer is a relatively nonstretching sheet, such as a fabric. The second layer is a thin base (or tie coat or coats) which bonds strongly to the first layer or fabric. The third layer is an intermediate coating or series of coatings of a thermoset material, or a thermoplastic material of a relatively high melting temperature. The fourth layer is a coating or series of coatings of a thermoplastic material having a melting temperature moderately below that of the intermediate coating(s). During the heating of the upper and lower sheets, the inner coating softens to some extent to permit some of the filaments of the foam core to bond to or actually penetrate into the softened fourth layer, with other filaments coming into bonding contact against the surface of the fourth layer. During the subsequent cooling step, the filaments then become securely bonded to the inner or fourth layer.

In the years during which the above process has been practiced, the formation of the sheets has been a critical factor. For reasons of material costs, and also to make the air mattress flexible and lightweight, the sheets must be made quite thin. For example, the total thickness of the sheet may be as low as 0.01 of an inch, with the two film layers each being as small as 0.001 to 0.002 of an inch in thickness. Yet, the two films of the sheet must be of sufficiently consistent quality to provide reliable bonding to the foam, and yet the total construction must be air impervious.

The common prior art method of forming the sheets used in the process noted above is to coat a fabric layer with successive layers of a liquid solution of a material such as polyurethane dissolved in a suitable solvent. A thin coat of the solution is applied to one side of the fabric, and the fabric with the thin liquid coating is then dried at a moderately elevated temperature to drive off the solvent, thus leaving a thin coating of the cured polyurethane. Then a second layer of the liquid is applied in the same manner, and subsequently heated to form an additional coating of the cured polyurethane. After several such applications of liquid followed by heating, the base coat is formed. The same procedure is used repeatedly using resins of different melting temperatures to build up the intermediate and inner layers to adequate thickness to function satisfactorily.

In the past, there have been attempts to simplify the overall mattress making process described above, and a substantial amount of this effort has been devoted to improving and simplifying the method of manufacturing the sheet used in making the air mattress. For example, instead of applying successive layers of a liquid, followed by intermediate steps of drying through the application of heat, it has been attempted simply to apply layers of solid film material against the fabric to form the two film layers of the sheet. However, in the past such attempts have been generally unsatisfactory, and it was not possible to maintain proper quality, particularly maintaining the bond strength to the first layer and the air impervious quality of the sheets.

A search of the U.S. patent literature did not reveal any patents particularly relevant to the teachings of the present invention or the problems encountered in the above described process. However, the patents noted in that search are recited herein as background information relating to films and adhesives in general.

U.S. Pat. No. 3,623,943, Feldmellen et al, shows a composite plate where there are outer metal sheets with a core made from a polyolefin layer. The metal is bonded to the core through an adhesive having a relatively low melting point, and between the adhesive and the polyolefin core, there is an intermediate layer of polyethylene having a relatively higher melting point.

U.S. Pat. No. 3,666,615, Toshiharu et al, discloses a layered sheet material to be used as electrical insulation. There is a thermosetting resin layer and a hardening agent layer, these two layers being separated by a contact-preventive film layer which melts on heating and allows the thermosetting resin layer and the hardening layer to react.

U.S. Pat. No. 4,056,422, Staats, illustrates a two-stage process for laminating a polyester-polyethylene film to a substrate, such as a photograph. The substrate with the film being applied thereto is passed through a lower temperature set of rolls and then through a higher temperature set of rolls. The patent states that this eliminates an undesired "blush" that would otherwise interfere with the aesthetics of the underlying member (e.g. a photograph), and yet prevents the formation of bubbles. U.S. Pat. No. 4,273,827, Sweeney et al, discloses an adhesive assembly having first and second adhesives with a barrier separating the two adhesives.

It is an object of the present invention to provide an improved overall method for making an inflating member, such as the self-inflating air mattress described above, and particularly to provide an improved method of forming the sheets used in that overall process. The instant process is less expensive, with the sheets being tougher and more air impervious because they are made a solid polymer film instead of solvent applied layers of resin. This also makes the system more tolerant to physical flaws in the fabric. It is a further object to provide an inflatable member, such as the air mattress noted above, made from such process.

SUMMARY OF THE INVENTION

In accordance with one aspect of the present invention, the method is to make a foam filled, inflatable member, such as an air mattress. The method first comprises provided a laminant sheet material by:

1. providing a first substantially non-stretching sheet layer;
2. providing a first solid polymer film layer which is structurally stable at a predetermined first higher temperature level;
3. bonding said first film layer to said sheet layer;
4. providing a second solid polymer film layer having a melting temperature which is at a predetermined second lower temperature level;
5. bonding the second film layer to the first film layer, thus making said laminated sheet material, which comprises said sheet layer, said second film layer and said third film layer.

Then, there is provided from said sheet material upper and lower sheet sections. A prebonded assembly is made by placing an intermediate foam core between the two sheet sections. Then the sheet sections are heated to soften the second film layers of the sheet sections, thus causing the foam core to come into proper prebonding engagement with the second film layers of the sheet sections.

The sheet sections are cooled to cause the foam core to become bonded to the two sheet sections. The method is characterized in that the first higher temperature level is sufficiently higher than the second temperature level that a difference between the two temperatures is sufficiently great so that air impervious integrity of the sheet sections is maintained.

Desirably, the temperature difference is at least approximately 30° F.

Also, in the preferred form, a coating of base film material is applied to the first fabric layer, after which the first film layer is bonded to the first fabric layer by being bonded to the base coating.

The first and second film layers are desirably made of a material selected from a group consisting of polyethylene, polyvinylchloride, polyvinylidene chloride, and/or vinylidene chloride copolymers, polypropylene, polybutylene, polyester and combinations thereof.

In the preferred embodiment, the first and second film layers comprise polyurethane.

Also, in the preferred embodiment, the edge portions of the sheet sections are bonded to one another along a peripheral seam having a generally T-shaped configuration, with the second film layers being bonded to one another at the seam.

In a variation of the method, at least one of the first and second film layers is applied as a plurality of film layer sheet portions which are bonded to one another.

Also, in the preferred embodiment, the first film layer is a thermoplastic material having a melting temperature at least approximately 30° F. greater than the melting temperature of the second film layer.

The inflatable member made according to the method described above is characterized in that surface portions of the foam core are inter-engaged with the second film layer so as to be securely adhered thereto, with the first layer providing an air impervious barrier for the sheet.

In accordance with another aspect of the present invention, the two sheet sections are bonded one to another along the edge portion so as to form the T-joint configuration at the edge portions of the sections.

Other features of the present invention will become apparent from the following detailed description.

BRIEF DESCRIPTION OF THE DRAWING

FIG. 1 is an isometric view of an air mattress made in accordance with the present invention, with the mattress being shown in its inflated condition for use;

FIG. 2 is a transverse sectional view taken along line 2—2 of FIG. 1;

FIG. 3 is a sectional view, drawn to an enlarged scale, detailing the structure of the foam and the mattress envelope at the edge portion of the mattress;

FIG. 4 is a sectional view of an edge portion of a prebonded assembly, which is provided as part of an intermediate step in the making of the air mattress;

FIG. 5 is a view similar to FIG. 4, illustrating heated platens being applied to the assembly of FIG. 4;

FIG. 6 is a view similar to FIG. 5, illustrating the air mattress assembly in the platen after a vacuum has been applied to the air mattress assembly to hold the assembly in bonded relationship during removal and cooling of the assembly;

FIGS. 7–9 are enlarged sectional views illustrating the top sheet of the assembly, and the foam core in detail at three different stages of the process, namely assembly, bonding and inflating after cooling, respectively;

FIG. 10 is a schematic view illustrating the prior art method of applying successive coatings to a fabric to form a sheet for an air mattress;

FIG. 11 is a schematic view illustrating the method of applying a film sheet to a fabric in accordance with the present invention.

DESCRIPTION OF THE PREFERRED EMBODIMENT

Figure 12:
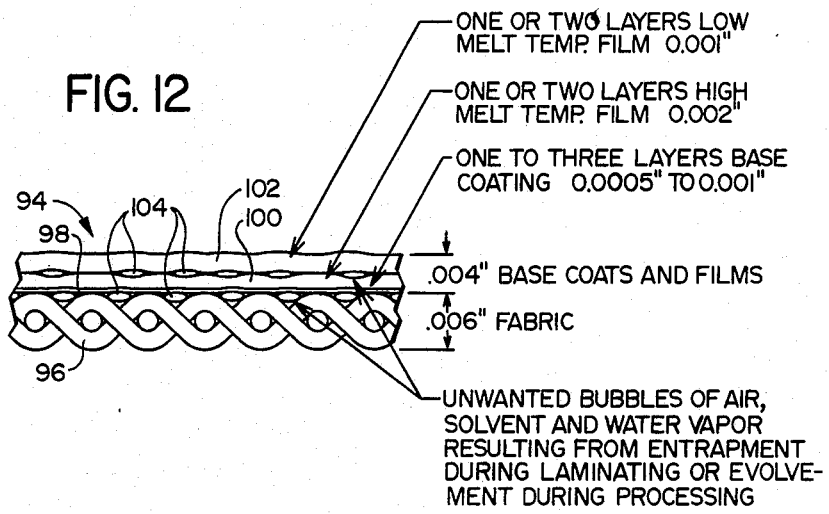
FIG. 12 is a cross sectional view of the sheet material drawn to an enlarged scale and illustrating entrapment of bubbles in the sheet material.

The more critical aspects of the present invention involve the formation and utilization of the laminated sheet material in making an inflatable member. More particularly, the present invention was conceived as part of an overall effort to make improvements in the method of making a self-inflating air mattress, such as that described in the aforementioned U.S. Pat. No. 4,025,974. Accordingly, while the broader aspects of the present invention go beyond the application to the precise process described in that patent, it is believed that a clearer understanding of the unique features and advantages of the present invention will be achieved by describing it as applied particularly to the method and air mattress disclosed in U.S. Pat. No. 4,025,974.

With reference to FIGS. 1 and 2, there is shown an air mattress 10 having a flat, rectangular configuration and comprising upper and lower sheets or skin sections 12 and 14, respectively, which are bonded one to another about their entire perimeter to provide an air impervious envelope enclosing a core 16 of a lightweight, resilient, open cell foam material. As shown in FIG. 3, each of the sheets or skins 12 and 14 comprises an outer layer of a substantially nonstretchable fabric 18 made of nylon or some other stretch resistant material, next a base or tie layer to facilitate subsequent lamination to fabric 18, an air impervious intermediate layer 20, and a third innermost layer of material 22 to which the foam core 16 is bonded and which facilitates the peripheral bond. As indicated previously, the formation of the two sheets or skin sections 12 and 14 is critical to the present invention, and this will be discussed more fully later herein.

The edge joint or seal 24 at which the two sheets 12 and 14 are joined about their entire perimeter is made by bonding the two inner surfaces of the sheets 12 and 14 together about their entire perimeter to form a "T" joint or seam. There is a valve 25 comprising a thermoplastic polyurethane housing and a conventional valve member mounted therein. This valve 25 is bonded into one corner of the air mattress 10 during the manufacturing process.

In the overall process of making the air mattress 10, first the sheet material is prepared in accordance with specific teachings of the present invention which will be discussed later herein. This sheet material is cut or otherwise made into two rectangular sections 26 and 28 having dimensions moderately larger than the sheets or skin sections 12 and 14 which are part of the end product which is the mattress 10. A section of foam core 30 is provided, this core having the same rectangular configuration as the core 16 which is in the finished air mattress 10.

Initially, the core 30 and the two sheet sections 26 and 28 are formed in a sandwich-like prebonded assembly, as shown in FIG. 4. More specifically, there is provided upper and lower perimeter frames 32 and 34 which grip the edge portions of the sheet sections 26 and 28. (For convenience, only one part of the perimeter frames 32 and 34 are shown in edge section, it being understood that the perimeter frames 32 and 34 have a general rectangular configuration moderately larger than that of the air mattress 10.)

In FIG. 5, the prebonded assembly 36, made up of the frames 32 and 34, the sheet sections 26 and 28, the core 30 and vent tube 25 positioned therebetween, is placed between upper and lower heated platens 38 and 40, and the platens 38 and 40 are moved against one another so that the main flat surfaces 42 and 44 of the platens 38 and 40, respectively, press against the rectangular sheet sections 26 and 28 with moderate pressure. The heat from the platens 38 and 40 causes the inner film layer 22 of the two sheet sections 12 and 14 to soften moderately so that some of the filaments of the core 16 protrude moderately into the film layer 22, while others come into bonding contact with the surface of the film laminant 22. At the same time, two perimeter portions 46 and 48 of the platens 38 and 40 press against upper and lower edge portions 50 and 52 of the sheet sections 26 and 28 to press these together into bonding engagement.

After the platens 38 and 40 have been in contact with the sheet sections 26 and 28 for a relatively short period of time (e.g. 15 seconds), air is drawn out of the interior of the prebonded assembly 36. This is accomplished by applying a suction through a vacuum hose that is attached to the valve housing of the valve 25, this valve housing having been placed into a corner of the bonding assembly 36 (as shown in FIG. 6) at an earlier time. The purpose of applying the moderate vacuum is to make sure that the filaments of the core 30 remain in proper engagement with the softened inner layers of the sheet sections 26 and 28. With the vacuum still applied, the surfaces of the skin sections 26 and 28 are cooled to cause the inner surfaces of the sheet sections 26 and 28 to harden. This can be accomplished quite conveniently by removing the assembly from the platens and immersing the assembly 36 in a tank of cold water, or by spraying cold water against the surfaces of the sheet sections 26 and 28. Then, the vacuum source is shut off from the valve housing, and pressurized air is directed into the interior of the mattress which is being formed. The perimeter frames 32 and 34 are separated, and the mattress is removed from the frames 32 and 34. Then the edges of the mattress are trimmed to make the finished air mattress 10.

To illustrate in more detail the manner in which the sheet sections 26 and 28 are bonded to the foam core, reference is made to FIGS. 7–9, where a small portion of the upper sheet section 26 and the adjacent portions of the foam core 30 are shown to an enlarged scale. It can be seen that the section 26 comprises an upper fabric layer 54, a relatively thin base layer 55, an intermediate layer 56, and an inner layer 58.

When the prebonding assembly is formed as in FIG. 4, the sheet section 26 presses against the foam core 30 only very lightly, so there is substantially no compression of the core 30. When the heated platen 38 is pressed against the sheet section 26, as shown in FIG. 5, the foam core 30 is compressed moderately, and at the same time, the heat from the platen 38 softens the innermost layer 58. The result is that some of the filaments 60 that are adjacent the innermost layer 58 are pushed into the softened inner layer 58, while other filaments 60 press against the surface of the softened layer 58. Then, when the bonding assembly 36 is removed from the platens and water or some other cooling medium is applied to the sheet sections 26 and 28, the innermost layer 58 hardens so that the filaments 60 become bonded to the sheet section 26 by adhering to the innermost layer 58.

When the mattress thus made is pressurized moderately from within, the upper and lower sheet sections 26 and 28 (which become the skin sections 12 and 14, respectively, of the finished mattress) are pushed away from each other moderately, thus applying moderate tension loads on the foam core 30 (which becomes the core 16 of the finished mattress 10). The result is that some of the unwanted filament bonds break away from the sheet sections 26 and 28 allowing the film to return to full loft or thickness.

By way of clarification, the air mattress shown in FIGS. 1-3, and the processing steps shown in FIGS. 4-9 are, in and of themselves, known in the prior art. However, in the prior art process, the sheet material is made differently than in the present invention, and the character of the prior art sheet material used differs from the present invention. Thus, while the above explanation presented in connection with FIGS. 1-9 is reasonably representative of the air mattress and the processing steps which exist in the prior art, it is intended that these are shown in FIGS. 1-9 as they apply to the present invention.

Reference is now made to FIG. 10, which is a somewhat schematic side elevational view of an apparatus which is used to make the prior art material from which the sheet sections 26 and 28 are cut. There is a long sheet of fabric 62 which is unwound from a first roll 64 and wound onto a second roll 66. The fabric 62 travels from the roll 64 over a backing roll 68, above which is a doctor knife 70. A liquid material 72 is applied in a suitable manner at the front side of the doctor knife 70 so that as the fabric 62 travels beneath the liquid material 72 and then beneath the doctor knife 70, a very thin layer of the liquid material is applied to the surface of the fabric 62.

Then the fabric 62 with the liquid material applied thereon passes through an oven 74 which heats the fabric 62 with the material 72 thereon to drive off the solvent from the liquid material 72. This oven 74 could be at a temperature of approximately 220° F., and the oven 74 may be made up of two or more heating zones, where the temperature becomes successively greater as the fabric 62 moves through the oven 74. The fabric 62 leaving the oven 74 is then wound onto the second roll 66. The liquid material 72 can be made up of, for example, a solvent such as dimethylformamide, and the solute can be, for example, polyurethane, with a suitable cross linking agent such as melamine. The liquid material could be, by weight, approximately 70% solvent, and 30% solute. The actual thickness of the liquid film at the time of application could be, for example, approximately 0.001 inch. However, when the solute is driven off in the oven 74, the resulting layer could be, for example, about 0.0003 inch. This layer is strongly bonded to the fabric by chemical reaction between the base or tie coat and the fabric.

With the first thin layer of polyurethane applied, then the same process as described above can be repeated several more times to apply successive thin layers of polyurethane. In accordance with the prior art method which has been used for a number of years in making these air mattresses, the intermediate air impervious layer 56 which is applied to the base or tie coat is made of a thermoset polyurethane material or a thermoplastic polyurethane material having a higher melting point of about 360° F. Then the innermost layer 58 is formed by following the same process as indicated above, but the polyurethane material which is the solute that is deposited on the surface has a moderately lower melting temperature (e.g. 290° to 320° F.). The sheet material made in accordance with the prior art process noted above has been used for a number of years to make air mattress, such as shown in FIG. 1, of generally highly consistent quality.

Recent efforts to make the required tie coating, intermediate air impervious layer and bond layer construction required for sheets 26 and 28 by heat laminating films to the tie or base coating resulted in sheets 12 and 14 which had a great propensity to pinhole, losing their air holding ability, where there was contact with the foam core 16, but also at the seams where the "T" joint 24 is formed by the two sheets 12 and 14 being bonded to one another.

However, it has now been discovered that it is possible to make an inflatable member, such as the self-inflating air mattress described above, where, as a preliminary step in the process, the sheet material is formed by bonding to a fabric two or more solid film sheets made of a thermoplastic material such as polyurethane, where the melting temperature of the inner layer 58 is at least approximately 30° F. less than the temperature of the intermediate film.

As a preliminary step, the nylon fabric 78 has a thin base coat of polyurethane applied thereto. This can be accomplished by dissolving the polyurethane in a suitable solvent (as indicated above). The liquid is applied to the surface of the nylon fabric in the manner shown in FIG. 10, which is then cured at a temperature of about 220° F., as previously explained. This thin base coat is the surface to which a subsequent thin film sheet 56 of polyurethane can be bonded.

The two or more films can be applied to the underlying fabric in a conventional manner, as illustrated in FIG. 11. There is a roll 76 upon which is wound a long sheet of fabric 78. On a second roll 80, there is wound a solid thin film sheet 82 made of polyurethane of a relatively high melting temperature. The two sheets 78 and 82 are fed over a larger hot roller 84, and the two sheets are pressed by a mating roll 86 against the hot roller 84. The temperature of the hot roller 84 is sufficiently high to soften the sheet 82 to the extent that it becomes bonded to the fabric sheet 78. As the two sheets 78 and 82 flow as a single sheet 88 from the hot roller 84, the sheet can pass over a number of guide (or idler) rolls 90 and be wound onto a collecting roll 92.

Then the sheet 88 (made up of the fabric sheet 78 and the film sheet 82 bonded thereto) is again passed over the hot roller 84, and a second thin film sheet is applied to the surface of the high melt temperature thin film sheet 82 in the same manner as described above with reference to FIG. 11. However, the temperature of the roller 84 is somewhat lower, so that it is just sufficient to cause bonding of the lower melt temperature film to the higher melt temperature film 82. This then becomes the innermost film layer 58.

The sheet material 94 which is formed from the process recited above thus, in effect, has four layers, namely (a) an outer fabric layer 96, (b) a thin base coat(s) 98, (c) an intermediate, air impervious, high melting temperature film 100, and (d) a lower melting temperature film 102. This sheet 94 is cut into sections 26 and 28 of the appropriate dimensions and then used quite effectively in making the air mattress 10 in accordance with the steps described with reference to FIGS. 3-6.

As indicated previously, it has been found that the sheets 94, made in the manner described above, can perform quite reliably in making the inflatable mattress 10. While all of the reasons for the effective use of this sheet material 94 are possibly not fully understood, the following hypothesis can, it is believed, be proposed with some justification.

It is believed that when solid film sheets are bonded to the fabric sheet or to one another in a normal commercial operation, it is inevitable that small amounts of air may be entrapped between the film sheets, and between the film sheet and the fabric layer. When the temperature of the sheet is elevated to some extent, the solvent and/or water vapor absorbed in the films or coatings form bubbles, and the entrapped air bubbles expand. More specifically, when the sheet material is used in the air mattress making process described with reference to FIGS. 3–6 above, some of these bubbles may migrate through one or more of the film layers 98, 100 or 102 so as to destroy the air impervious nature of the sheet 94. Such bubbles are shown in the enlarged cross-sectional view of the sheet 94, as illustrated in FIG. 12.

It is believed that when, in accordance with the present invention, the melting temperature of the high temperature intermediate film 100 is made at least approximately 30° higher than that of the inner film 102, any entrapped bubbles have little if any effect on the inner film 100, so that it remains substantially air impervious. It may be that some of these air bubbles do migrate through the inner film 102, and through the nonimpervious fabric coating. But this does not destroy the air impervious integrity of the overall sheet 94. Further, even though some of the bubbles 104 may remain entrapped within the sheet 94, after the finished mattress 10 is made, these entrapped bubbles do not have any significant effect on the structural integrity of the upper and lower sheets 12 and 14 of the finished mattress 10.

With regard to the materials which are used in the method of the present invention, the fabric 96 is desirably a conventional nylon fabric, having an overall thickness of approximately 0.006 inch. The base or tie coating is similar to the base or tie coatings used in the prior art completely solvent coated system. The two films 100 and 102 are desirably each made of a solid sheet of polyurethane. The melting temperature of the intermediate film 100 is generally between about 365° to 385° F. The melting temperature of the innermost film 102 is generally between about 320° to 340° F. These melting temperatures are generally controlled by selection of polyurethanes which have higher molecular weight for the high melting point film 100 and lower molecular weight for the lower melting point film 102. However, the sheet 94 should be made so that the difference between the two melting temperatures of the films 100 and 102 should be at least about 30° F. Within the broader scope of the present invention, it is conceivable that this melting temperature difference could be made smaller (e.g. possibly 25° F. or even 20° F.), provided that processing conditions and quality control is watched very closely. However, by making the melting temperature difference at least approximately 30° F., the reliability of the overall process is substantially enhanced.

In addition to making the films 100 and 102 out of polyurethane, it would be possible to use other thermoplastic materials, such as polyethylene, polyvinylchloride, polyvinylidene chloride and/or vinylidene chloride copolymers, polypropylene, polybutylene, and polyester.

Also, instead of using a nylon fabric, within the broader scope of the present invention, it would be possible to use other suitable fabric having similar qualities, such as polyester, cotton, polypropylene, wool, cellulose, and polvvinylidene chloride and/or vinylidene chloride copolymers.

Also, it has been found that the sheet 94 made in accordance with the process described herein could be used quite effectively in an inflatable member where there is not a foam core. The inflatable member could be made having an edge joint or seam as illustrated in FIG. 3. Manufacturing experience in conjunction with the present invention has indicated that even though the main surfaces of such an inflatable member (i.e. one not having a foam core) might not be subjected to processing conditions which would result in the formation of leaks, the sheet material at, or adjacent to, the bonding areas when subjected to bonding conditions would cause the formation of leaks in the material, apparently due to bubbles in the film and coating layers or due to excessive deformation of the film when subjected to bonding loads and temperature. Materials made according to the invention but with insufficient difference in the bonding temperatures actually leaked as badly or worse along the edge seam as in the area where bonded to the foam. Thus, within the broader aspects of the present invention, it is contemplated that the sheet material 94 and the method of making the same would also be applicable to inflatable members which do not have a foam core, as described above. However, it is to be emphasized that the present invention has proven to be particularly effective for use in the process of forming the particular mattress 10, as described above.

As a quality control technique, to insure that the sheet material 94 will function effectively in the present invention, the sheet 94 can be examined as follows. First, the thickness of the sheet 94 is measured within tolerances of at least 0.005 inch. Then the temperature of the sheet is raised toward the predetermined melting temperature of the innermost film layer 102. At the same time, the inner surface of the sheet 94 is scraped by any suitable scraping tool, and the thickness is measured. (The thickness can be conveniently be measured by a micrometer gauge or other suitable measuring device.

If the thickness of the sheet 94 is reduced by an amount which is nearly equal to the thickness of the innermost layer 102, then it can be assumed that this innermost layer 102 will reach a suitable bonding temperature at the temperature where the innermost layer can be scraped off. The heating of the sheet 94 can be continued to increase the temperature to determine if the intermediate layer 100 remains in tact at a temperature about 30° F. higher than required to scrape off layer 102. This again can be done by applying a scraping tool to the inner surface of the sheet 94.

Figure 13:
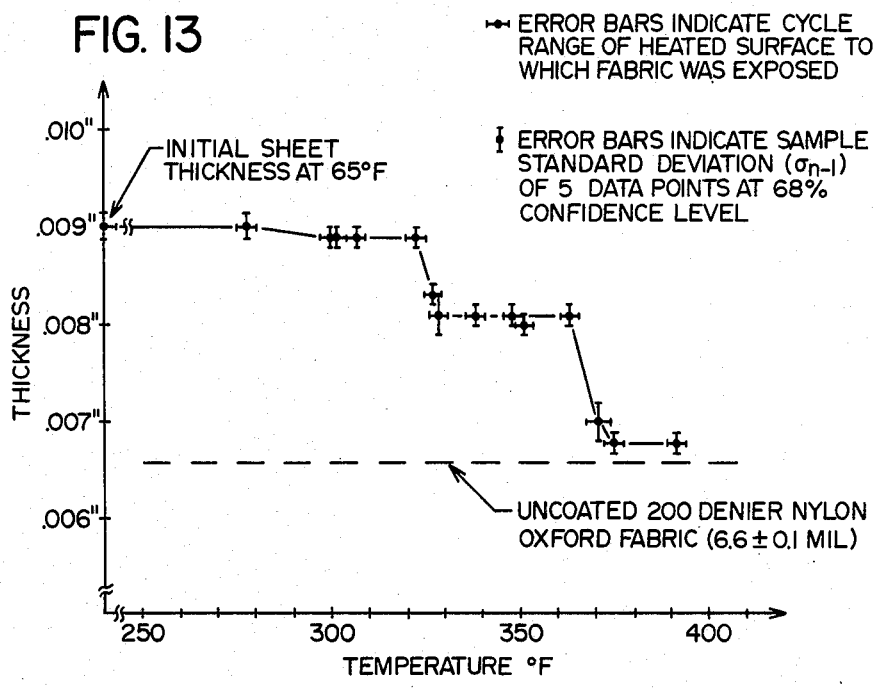
FIG. 13 is a graph where the thickness of the sheet of the present invention is plotted against temperature, with this graph illustrating the concept of a quality control method utilized in connection with the present invention, to determine film melting temperatures.

A graph illustrating this process is shown in FIG. 13. It can be seen that the thickness of the sheet 94 remains relatively constant until a temperature of approximately 320° F. Then, with light scraping, the thickness drops rapidly as film 102 is removed. As the temperature approaches 365° F., the thickness of the sheet 94 again drops. Thereafter, the thickness of the sheet 94 remains substantially constant until it reaches a much higher temperature where the base or tie coats begin to deterioriate, leaving only the original uncoated fabric thickness.

This same characteristic can be seen when fully solution-coated fabric are tested in a like manner, but the changes in direction of the curve are not so abrupt.

Also, it should be noted that the base coats may be made up of several different melt temperature layers to facilitate bonding to the high melt temperature film 100.

We claim:

1. In a method of making a foam filled, inflatable member, such as an air mattress, said method comprising:

a. providing a laminated sheet material by:
   1. providing a first substantially nonstretching sheet layer;
   2. providing a first solid polymer film layer which is structurally stable at a predetermined first higher temperature level;
   3. heat laminating said first film layer to said sheet layer;
   4. providing a second solid polymer film layer having a melting temperature which is at a predetermined second lower temperature level;
   5. heating laminating the second film layer to the first film layer, thus making said laminated sheet material, which comprises said first sheet layer, said first film layer and said second film layer;

b. providing from said sheet material upper and lower sheet sections, and making a prebonded assembly where an intermediate open cell foam core is positioned between the sheet sections;

c. heating said sheet sections to soften the second film layers of the sheet sections and causing said foam core to come into proper prebonding engagement with the second film layers of the sheet sections;

d. cooling the sheet sections to cause the foam core to become bonded to the two sheet sections;

e. said method being characterized in that the first higher temperature level is sufficiently higher than said second temperature level that a difference between the two temperatures is sufficiently great so that air impervious integrity of the sheet sections is maintained.

2. The method as recited in claim 1, wherein said temperature difference is at least approximately 30° F.

3. The method as recited in claim 1, wherein in making the sheet material, a coating of a base film material is applied to said first sheet layer, after which said first film layer is bonded to the first sheet layer by being bonded to said base coating.

4. The method as recited in claim 1, wherein said first and second film layers are made of a material selected from a group consisting of polyethylene, polyvinylchloride, polyvinylidene chloride, and/or vinylidene chloride copolymers, polypropylene, polybutylene, polyester and combinations thereof.

5. The method as recited in claim 1, wherein said first and second film layers comprise polyurethane.

6. The method as recited in claim 1, wherein edge portions of the sheet sections are bonded to one another along a peripheral seam having a generally T-shaped configuration, with said second film layers being bonded to one another at said seam.

7. The method as recited in claim 1, wherein at least one of said first and second film layers is applied as a plurality of film layer sheet portions which are bonded to one another.

8. The method as recited in claim 1, wherein said first film layer is a thermoplastic material having a melting temperature at least approximately 30° F. greater than the melting temperature of the second film layer.

9. The method as recited in claim 1, wherein:

a. said temperature difference is at least approximately 30° F.;

b. in making the sheet material, a coating of a base film material is applied to said first sheet layer, after which said first film layer is bonded to the first sheet layer by being bonded to said base coating.

10. The method as recited in claim 9, wherein edge portions of the sheet sections are bonded to one another along a peripheral seam having a generally T-shaped configuration, with said second film layers being bonded to one another at said seam.

11. An inflatable member made according to the method of claim 1, wherein said inflatable member is characterized in that surface portions of the foam core are interengaged with said second film layer so as to be securely adhered thereto, with said first film layer providing an air impervious barrier for said sheet.

12. The inflatable member as recited in claim 11, wherein said sheet sections have a polymer base coating interposed between said sheet layer and said first film layer.

13. The inflatable member as recited in claim 11, wherein said first and second film layers comprise polyurethane.

14. The inflatable member as recited in claim 11, wherein said first and second sheet sections are bonded one to another at edge portions thereof along a seam formed in a T-joint configuration, with portions of said second film layers being bonded one to another at said seam.

15. The inflatable member as recited in claim 11, wherein:

a. said sheet sections have a polymer base coating interposed between said sheet layer and said first film layer;

b. said first and second sheet sections are bonded one to another at edge portions thereof along a seam formed in a T-joint configuration, with portions of said second film layers being bonded one to another at said seam.

16. In a method of making an inflatable member, said method comprising:

a. providing a laminated sheet material by:
   1. providing a first substantially nonstretching sheet layer;
   2. providing a first solid polymer film layer which is structurally stable at a predetermined first higher temperature level;
   3. heat laminating said first film layer to said sheet layer:
   4. providing a second solid polymer film layer having a melting temperature which is at a predetermined second lower temperature level;
   5. heat laminating the second film layer to the first film layer, thus making said laminated sheet material, which comprises said sheet layer, said first film layer and said second film layer;

b. providing from said sheet material upper and lower sheet sections, and making a prebonded assembly where edge portions of the sheet sections are placed in contact with one another to form a T-joint edge configuration with portions of the second films being pressed against one another at the edge portions of the sheet sections;

c. heating at least the edge portions of the sheet sections to soften the second film layers of the sheet sections at the edge portions;

d. cooling the sheet sections at the edge portions to cause the two sheet portions to become bonded to one another at the edge portions;

e. said method being characterized in that the first higher temperature level is sufficiently higher than said second temperature level that a difference between the two temperatures is sufficiently great so that air imprevious integrity of the sheet sections is maintained.

17. The method as recited in claim 16, wherein said temperature difference is at least approximately 30° F.

18. The method as recited in claim 16, wherein in making the sheet material, a coating of a base film material is applied to said first sheet layer, after which said first film layer is bonded to the first sheet layer by being bonded to said base coating.

19. The method as recited in claim 16, wherein said first and second film layers are made of a material selected from a group consisting of polyethylene, polyvinylchloride, polyvinylidene chloride, and/or vinylidene chloride copolymers, polypropylene, polybutylene, polyster and combinations thereof.

20. The method as recited in claim 16, wherein said first and second film layers comprise polyurethane.

21. The method as recited in claim 16, wherein at least one of said first and second film layers is applied as a plurality of film layer sheet portions which are bonded to one another.

22. The method as recited in claim 16, wherein said first film layer is a thermoplastic material having a melting temperature at least approximately 30° F. greater than the melting temperature of the second film layer.

23. The method as recited in claim 16, wherein:

a. said temperature difference is at least approximately 30° F.;

b. in making the sheet material, a coating of a base film material is applied to said first sheet layer, after which said first film layer is bonded to the first sheet layer by being bonded to said base coating.

24. An inflatable member made according to the method of claim 16, wherein said inflatable member is characterized in that said second film layers of the sheet sectons function to bond the edge portions of the sheet sections, with said first layer providing an air impervious barrier for said sheet.

25. The inflatable member as recited in claim 24, wherein said sheet sections have a polymer base coating interposed between said sheet layer and said first film layer.

26. The inflatable member as recited in claim 24, wherein said first and second film layers comprise polyurethane.

* * * * *